United States Patent [19]

Labbe

[11] 4,186,754

[45] Feb. 5, 1980

[54] CIGARETTE MANUFACTURE

[75] Inventor: Francis A. M. Labbe, Neuilly-sur-Seine, France

[73] Assignee: Molins Limited, England

[21] Appl. No.: 814,043

[22] Filed: Jul. 8, 1977

[30] Foreign Application Priority Data

Jul. 14, 1976 [GB] United Kingdom ..... 29222/76

[51] Int. Cl.[2] ..... A24C 5/14

[52] U.S. Cl. ..... 131/23 A

[58] Field of Search ..... 131/23 R, 77, 23 A, 131/78; 100/73, 74, 75; 134/122 R; 401/265, 266

[56] References Cited

U.S. PATENT DOCUMENTS

| | | | |
|---|---|---|---|
| 2,330,010 | 9/1943 | Ruau | 131/23 A |
| 2,617,426 | 11/1952 | Patterson | 131/23 A |
| 2,743,845 | 5/1956 | Jones, Sr. | 401/266 |
| 3,033,211 | 5/1962 | Godfrey | 131/23 A |
| 3,184,888 | 5/1965 | Fruth et al. | 401/205 |

*Primary Examiner*—V. Millin

*Attorney, Agent, or Firm*—Craig and Antonelli

[57] ABSTRACT

A cigarette making machine includes a tongue by which the tobacco is compressed to its final cross-section, characterized by a liquid feeding arrangement for feeding liquid to the surface of the tongue in contact with the tobacco to dilute and reduce the viscosity of any gum from the tobacco which comes into contact with the tongue.

9 Claims, 12 Drawing Figures

CIGARETTE MANUFACTURE

Cigarette making machines commonly include a tongue by which a continuously moving tobacco stream is compressed to its final cross-section before being enclosed in a continuous wrapper to form a cigarette rod.

This invention is concerned with the manufacture of cigarettes in conditions (arising from the nature of the tobacco or from its condition, e.g. of temperature and/or humidity) in which gum, flavouring sauce or other viscous liquid material tends to be squeezed out of the tobacco in the region of the tongue. For convenience we will refer to such materials simply as "gum".

In this context the term "tobacco" is intended to include cigarette filler materials including or comprising non-tobacco ingredients, e.g. tobacco substitute materials. This invention is particularly relevant in the case of relatively short tobacco, i.e. tobacco of which the shreds are relatively short or small.

The gum can tend to form a coating on the inner surface of the tongue. This coating increases the frictional drag on the tobacco, which increases the already high temperature of the tobacco and heats up the tongue. After a while, the coating attains a high viscosity which can ultimately retard the tobacco adjacent to the tongue and can cause the tobacco under the tongue to roll.

A cigarette making machine according to the present invention includes a tongue by which the tobacco is compressed to its final cross-section and which has a supply passage through which liquid is delivered during use to dilute the gum which is in contact with the tongue to reduce its viscosity. The liquid may, for example, be water or some other solvent (e.g. alcohol) for the gum or other material which oozes out of the tobacco; for convenience, reference will be made only to water.

The water may be supplied continuously. Alternatively, it may be supplied at timed intervals, for example at approximately 1 minute intervals. In this last case the water should be supplied in quantities sufficient to wet the tobacco significantly, so that the wet tobacco can then wipe clean the tongue. The delivery of water may be so timed that the knife which cuts the continuous rod into individual cigarette portions passes through the wetted portions of tobacco so that the knife itself is also wiped clean.

Examples of cigarette making machines according to this invention are shown in the accompanying drawings. In these drawings.

Figure 1:
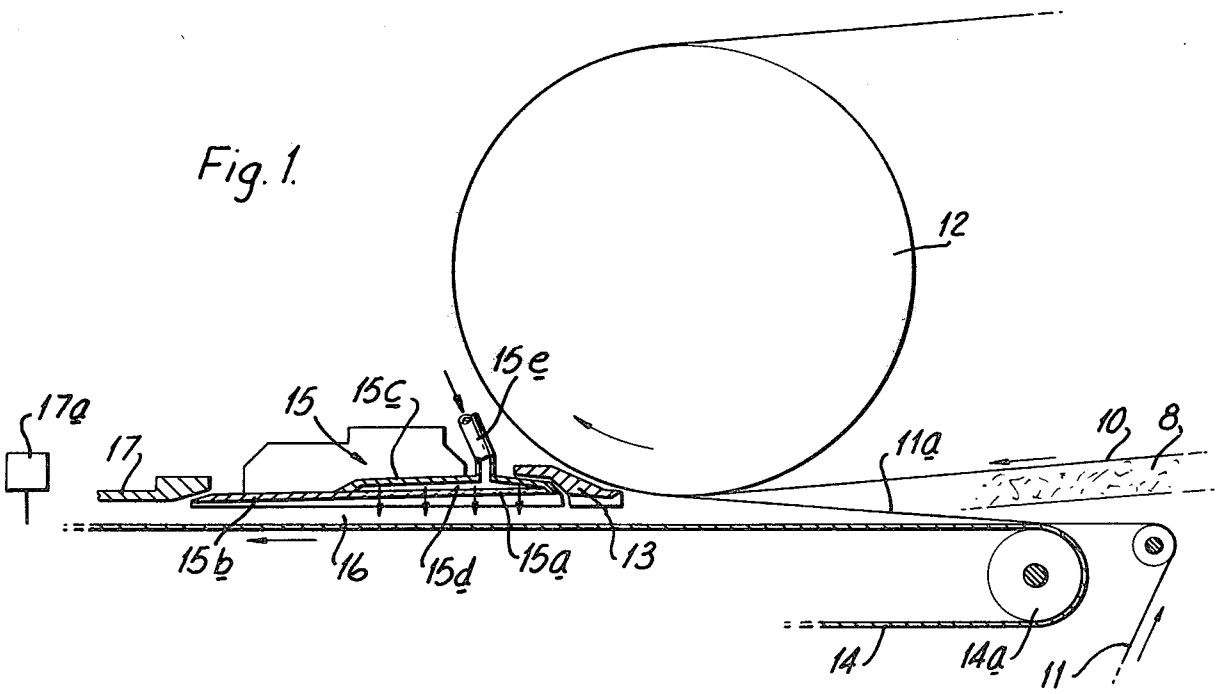
FIG. 1 is a sectioned elevation of part of one machine including the tongue.

FIG. 1 shows part of a cigarette making machine in which a continuous cigarette filler stream 8 (only a section of which is shown) is delivered on to a continuous wrapper web 11 of paper by a band 10, for example basically as described in British patent specification No. 798,308, 882,192 or 916,141. The band 10 returns around a pulley 12, and a shoe 13 helps to remove the filler stream from the band.

After leaving the band 10, the filler stream is driven forward by the paper web 11, which is itself carried by a garniture tape 14; the edges 11*a* of the paper are bent upwards by the garniture tape (in a well known manner) to form a trough section for receiving the filler stream. A tongue identified generally as 15 defines with the wrapper web a passage 16 which decreases progressively in cross-section in the direction of movement of the filler stream and progressively assumes a substantially circular cross-section so as to form the filler stream into the required cross-section of the finished cigarette rod. A rod-forming section downstream of the tongue (of which part 17 is shown) secures the wrapper web around the filler stream to form a continuous cigarette rod. A cutting device (17*a* ) then cuts the rod at regular intervals into individual cigarette portions in a well-known manner.

The operative part of the tongue which engages the tobacco includes a porous part 15*a* and a non-porous part 15*b*. Above the porous part 15*a* there is a concave member 15*c* defining with the part 15*a* a chamber 15*d* into which water is fed via an inlet pipe 15*e*. A vertical cross section through the inlet pipe is similar to FIG. 3 and will be discussed further on in connection with FIG. 2.

Figure 2:
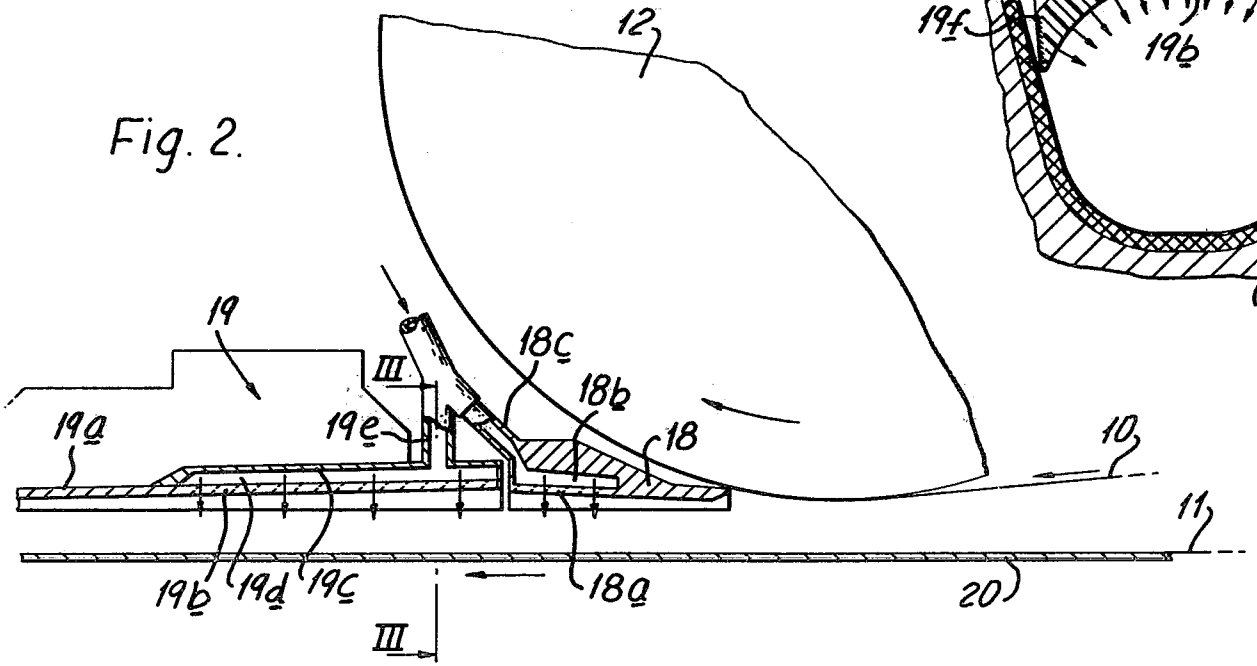
FIG. 2 is a similar view of another machine on a larger scale.

The shoe 13 shown in FIG. 1 is cut away to allow the tongue to extend beneath part of the shoe. FIG. 2 shows an alternative construction including a shoe 18 which is hollowed out and has a porous member 18*a* forming a chamber 18*b* into which water is fed via an inlet pipe 18*c*. The tongue 19 in this instance is similar to the tongue 15 shown in FIG. 1 except that it is somewhat shorter. As in FIG. 1, it includes a non-porous part 19*a* and a porous part 19*b* above which there is a concave member 19*c* forming a chamber 19*d* into which water is fed through an inlet pipe 19*e*.

Figure 3:
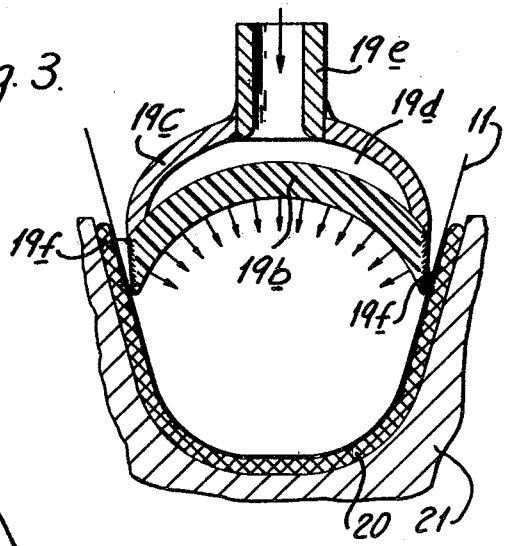
FIG. 3 is a section, on a larger scale, on the line III–III in FIG. 2.

FIG. 3 shows the shape of the inner surface of the tongue at the section line III–III in FIG. 2 and also shows the shape assumed by the garniture tape 20 at that point. The garniture tape 20 is supported by a stationary garniture bed member 21. The garniture tape is flat where it passes around the pulley 14*a* (see FIG. 1) and then becomes progressively more deeply curves so as to form the paper web 11 into a trough section as shown in FIG. 3.

The porous part 19*b* of the tongue may, for example, be of sintered bronze. To prevent sideways leakage directly on to the paper web 11, the side edges 19*f* should be sealed, for example by being impregnated with an epoxy resin.

The water may be fed through the pipes 18*c* and 19*e* at room temperature or may be slightly heated to assist in diluting the gum which tends to deposit on the tongue. The quantity of water which is required can be determined by experiment. However, it is envisaged that, for the manufacture of cigarettes at 4000 cigarettes per minute, not more than about 3 cc/minute of liquid (preferably water) need be used; for example 1 cc/minute may be used.

Figure 4:
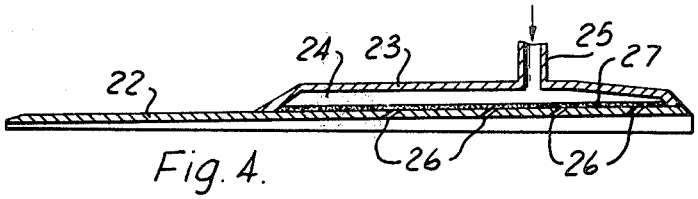
FIG. 4 is a longitudinal section of a different tongue.
Figure 5:
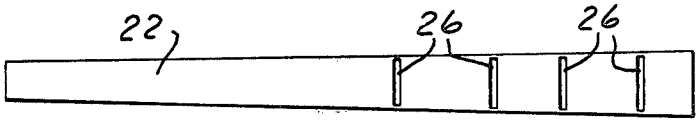
FIG. 5 is a view from underneath the tongue shown in FIG. 4.

FIG. 4 shows an alternative tongue for use in place of the tongue 15 in FIG. 1. The part 22 of the tongue which contacts the tobacco is formed entirely of non-porous material, for example steel or brass. Above the upstream portion of the tongue there is a concave member 23 forming a chamber 24 into which water is supplied through an inlet 25.

In the region below the chamber 24, the part 22 of the tongue is formed with forwardly inclined slots through which water passes onto the tobacco adjacent to the tongue. A sheet 27 of wick material covers the slots 26 so as to filter the water. The sheet 27, which may for example be of felt, also tends to ensure that water flows evenly through the various slots 26. The part 23 of the tongue may be readily removable so that the sheet 27 can be replaced from time to time.

Figure 6:
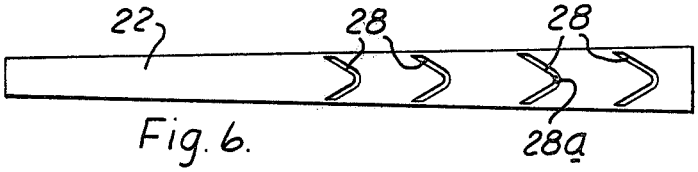
FIG. 6 to 9 are similar to FIG. 5 but show modified tongues.
Figure 7:
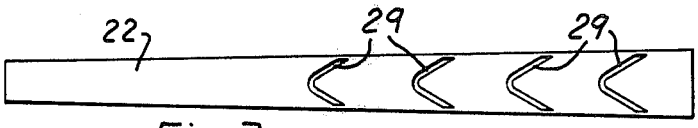
Figure 8:
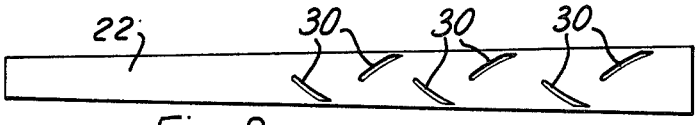

FIG. 6 to 8 show the part 22 of the tongue with slots 28, 29 and 30 respectively forming different patterns. In each case, however, the slots should preferably be forwardly inclined as viewed in a longitudinal cross-section to ensure that there is no significant tendency for tobacco to enter the slots. Furthermore the forward inclination of the slots helps to draw the liquid downwards through the slots.

Instead of having slots 29, 29 or 30, the tongue shown in FIGS. 6 to 8 could have similarly shaped shallow grooves (e.g. 0.8 mm deep) with an aperture to feed the water onto the groove from the chamber 24. In one preferred arrangement there is only one V-shaped groove 28 (see FIG. 6) with a centre aperture 28*a* for feeding the water into the groove. The part of the tongue upstream of the groove (i.e. to the right) is preferably coated with a plastics material, e.g. in the form of self-adhesive tape.

Figure 9:
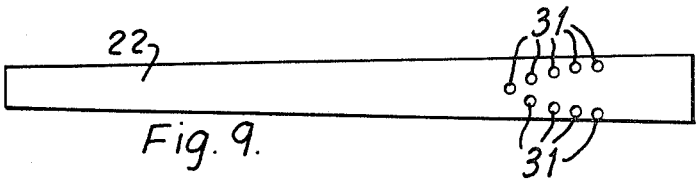

FIG. 9 shows a different arrangement in which there is a pattern of holes 31 instead of slots.

Figure 10:
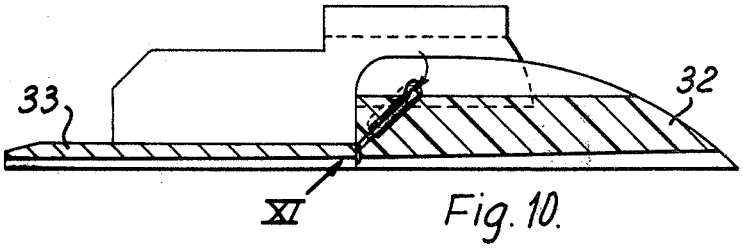
FIG. 10 is a longitudinal section of a different tongue.

FIG. 10 shows a different tongue which is of composite construction. That is to say, the tongue is in two parts, namely an upstream part 32 and a downstream part 33. The part 32 is formed from (or coated with) a plastics material to which gum has very little tendency to adhere, for example ultra high molecular weight polyethylene, high-density polyethylene, or one of the plastics materials known by the trade names Delrin, Nylon (possibly glass-filled) or Econol. The downstream part 33 of the tongue is formed of a hard-wearing material, preferably steel, to withstand the high pressure of the compressed tobacco in that region.

Figure 11:
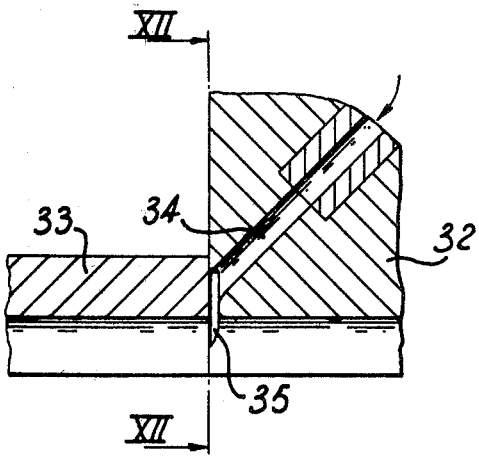
FIG. 11 is an enlarged view of part of the tongue shown in FIG. 10 identified by the arrow XI.
Figure 12:
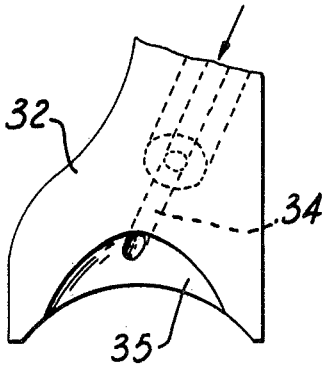
FIG. 12 is a section on the line XII–XII in FIG. 11.

As shown particularly in FIGS. 11 and 12, water is fed through a passage 34 in the part 32 to a concave recess 35 in the surface of the part 32 against which the part 33 of the tongue abuts. Water flows from this recess on to the layer of gum on the tobacco adjacent to the tongue to dilute the gum in contact with the tongue and to reduce the tendency for the gum from the tobacco to build up on the surface of the part 33 of the tongue. In the region of the upstream part 32 of the tongue the tobacco is not so heavily compressed and therefore has less tendency to lose its gum; furthermore, the low adhesion characteristic of the plastics material minimizes any tendency for gum to adhere to the part 32 of the tongue. However, a low-friction plastics material cannot be used for the entire tongue since it would not have sufficient resistance to wear at the downstream end where the pressure of tobacco on the tongue is greatest. At and near the downstream end of the tongue, the pressure of tobacco may be sufficient to wipe gum off the tongue, but (depending upon the nature of the tobacco) there may be an awkward region somewhere between the ends of the tongue in which a fairly significant quantity of gum is squeezed out of the tobacco and in which there is not sufficient tobacco pressure to wipe the gum away reliably, and it is owing to that awkward region that we have found that it is helpful to supply water through the tongue to dilute and thus reduce the vicosity of the gum as already mentioned.

The water may be fed to the passage 34 at a constant head. For example, in order to feed 1 cc/minute of water at 30° C., the water may be supplied at a head of 125 mm; it may be arranged to flow into the tongue from an elevated bottle via a narrow-bore pipe, e.g. one having a bore of 0.8 mm and a length of 100 mm.

Alternatively, as already mentioned, water may be pumped into the passage 34 at regular intervals. In this case the water wets the tobacco, which then wipes clean the downstream part 33 of the tongue. The cigarettes formed with this additionally moistened tobacco may be subsequently ejected. For this purpose it is helpful that the water is fed onto the tobacco at only one precise location, rather than through a number of slots or holes as in FIGS. 5 to 9.

I claim:

1. A cigarette making machine including a tongue by which the tobacco is compressed to its final cross-section, characterised by liquid feeding means formed in the tongue for feeding liquid to a surface of the tongue in contact with the tobacco to dilute and reduce the viscosity of any gum from the tobacco which comes into contact with the tongue.

2. A cigarette making machine including a tongue by which the tobacco is compressed to its final cross-section, characterized by liquid feeding means for feeding liquid to the surface of the tongue in contact with the tobacco to dilute and reduce the viscosity of any gum from the tobacco which comes into contact with the tongue, the liquid feeding means comprises a groove or recess extending across the surface of the tongue in contact with the tobacco, and a passage for feeding the liquid into the groove or recess.

3. A cigarette making machine according to claim 2 in which the part of the tongue upstream of the groove or recess is formed from or coated with a plastics material which tends to resist adhesion of gum.

4. A cigarette making machine including a tongue by which the tobacco is compressed to its final cross-section, characterized by liquid feeding means for feeding liquid to the surface of the tongue in contact with the tobacco to dilute and reduce the viscosity of any gum from the tobacco which comes into contact with the tongue, the liquid feeding means comprises a number of slos or apertures through which liquid is fed from a chamber above the tongue.

5. A cigarette making machine including a tongue by which the tobacco is compressed to its final cross-section, characterized by liquid feeding means for feeding liquid to the surface of the tongue in contact with the tobacco to dilute and reduce the viscosity of any gum from the tobacco which comes into contact with the tongue, the liquid feeding means is adapted to feed the liquid continuously to the surface of the tongue.

6. A cigarette making machine including a tongue by which the tobacco is compressed to its final cross-section, characterized by liquid feeding means for feeding liquid to the surface of the tongue in contact with the tobacco to dilute and reduce the viscosity of any gum from the tobacco which comes into contact with the tongue, the liquid feeding means is adapted to feed the liquid at predetermined intervals timed so that a final cut knife which cuts a continuous cigarette rod into separate portions passes through parts of a cigarette filler stream which are wetted by the liquid.

7. A tongue for use in a cigarette machine, the tongue being adapted to compress tobacco to its final cross-section, characterized by liquid feeding means for feeding liquid to the surface of the tongue in contact with the tobacco to dilute and reduce the viscosity of any gum from the tobacco which comes into contact with the tongue, the tongue having a concave underneath surface for compressing a cigarette filler stream and including at least one groove or recess extending across the underneath surface of the tongue, and a passage for feeding liquid to the groove or recess.

8. A tongue according to claim 7 of which the part upstream of the groove or recess is formed from or coated with a plastics material which tends to resist adhesion of gum.

9. A method of making cigarettes in which a cigarette filler stream of tobacco is conveyed towards a cigarette rod forming device while being mechanically compressed by a mechanical compressor means, characterised in that a liquid is fed through the mechanical compressor means to a surface thereof in contact with the tobacco to dilute and reduce the viscosity of any gum in the tobacco which comes into contact with the compressor means.

* * * * *